United States Patent [19]

Abbe et al.

[11] Patent Number: 4,858,722

[45] Date of Patent: Aug. 22, 1989

[54] SELF-CONTAINED MUFFLER ATTACHMENT AND CONVERSION KIT FOR SMALL TWO-CYCLE ENGINES

[76] Inventors: David C. Abbe, 1780 E. Chase Ave., El Cajon, Calif. 92020; John M. Tatone, 62 Bellhaven, Daly City, Calif. 94015

[21] Appl. No.: 247,735

[22] Filed: Sep. 22, 1988

[51] Int. Cl.[4] ..... F01N 7/18

[52] U.S. Cl. ..... 181/243; 181/240; 181/265; 181/272; 181/282; 181/296; 181/404

[58] Field of Search ..... 181/243, 765, 272, 282, 181/240, 404, 296

[56] References Cited

U.S. PATENT DOCUMENTS

| | | | |
|---|---|---|---|
| 2,943,695 | 7/1960 | Jeffords | 181/243 |
| 3,563,338 | 2/1971 | Rader | 181/243 |
| 4,031,979 | 6/1977 | Raleigh | 181/404 X |
| 4,316,523 | 2/1982 | Boretti | 181/243 X |
| 4,474,260 | 10/1984 | Valentine | 181/243 X |

*Primary Examiner*—B. R. Fuller

*Attorney, Agent, or Firm*—Kinney & Lange

[57] ABSTRACT

A kit includes a self-contained muffler which attaches to the output exhaust system of a small two-cycle engine, such as a model engine that is in the range of 0.15 to 1.25 cubic inches displacement. The kit provides a low cost adaptation of existing engine manifolds to meet required sound reduction guidelines of below 90 Db at nine feed from the engine. The kit is easily adapted and installed on a wide variety of manifold-muffler adaptations, for example model engines using a mounting bolt which clamps the kit muffler to a portion of the existing engine muffler.

6 Claims, 6 Drawing Sheets

SELF-CONTAINED MUFFLER ATTACHMENT AND CONVERSION KIT FOR SMALL TWO-CYCLE ENGINES

BACKGROUND OF THE INVENTION

1. Field of the Invention.

The present invention relates to a kit for and a method of reducing the sound for model engines in a low cost manner without complete replacement of existing mufflers or manifold headers.

2. Description of the Prior Art.

Various muffler adaptations have been made for model engines such as model airplane engines in particular, which are quite noisy, and which now have been subjected to stringent recommended standards of noise reduction. Many mufflers that attempt to keep back pressure on the engine low and also adequately reduce sound have been advanced, but these have been very expensive, and still have problems meeting the recommended noise limits.

Most of the small displacement engines use a two-piece "muffler" as illustrated in FIG. 1 of the present drawings, which is exemplary to the prior art. As shown in FIG. 1, a model engine of small displacement indicated generally at 10 in dotted lines has an output flange at 11, on which a manifold-muffler assembly 12 is mounted. The muffler has a mounting flange 13 that bolts onto the engine, and an internal passageway 14 opening to the exhaust port of the engine. A single expansion chamber is defined as indicated at 15 on the interior of the muffler 16 which includes a front half 17 and a rear half 18 joined along a threaded interconnection 19. A stinger pipe 20 is provided at the rear, and the single expansion chamber 15 will reduce the volume of sound, and at the same time, some back pressure is also produced for improved regulation of engine power. This can be a tuned type exhaust if desired.

A typical measured level of engine sound without any muffler will be in the range of 104 to 112 decibels (Db) at a distance of nine feet under a set of controlled test conditions. The addition of a factory stock muffler such as that shown in FIG. 1 reduces the sound about 80%, or in the range of 90 to 101 Db under the same set of controlled test conditions. Continuous sound over 90 Db is still painful and damaging to the human ear. It should be noted that each 3 Db amounts to a 50% sound reduction. In order to be "legal" or to meet guidelines, most engines must be reduced by at least 3 to 11 Db from factory muffler sound levels for them to operate satisfactorily.

By adding on standard factory mufflers and the like, back pressure is increased, and in addition the cost is substantially increased.

SUMMARY OF THE INVENTION

The present invention relates to a low cost method and kit for reducing the sound output of a model engine in a simple installation, using a light weight existing muffler for the kit that results in a dramatically more effective multichamber sound reducer. The net reduction of sound can be up to in the range of 3 Db per added chamber. The size, weight, fuel and heat resistance of the components, as well as the low cost are also factors which are available in the present method and kit to make a practical solution for the problem within the reach of most users of model engines.

In effect, the method includes removing the back half of the muffler-expansion chamber shown in FIG. 1, and drilling a hole in the front part of the muffler for passing an assembly bolt rearwardly. The bolt is a mounting bolt which is adapted to clamp a modified commercially available muffler. The commercially available muffler is modified to cut off the front mounting pipe to a suitable length, to reduce input throat restrictions, and drilling a mounting bolt hole in a center cross baffle that is already in the standard muffler. Exposed parts, such as where the bolt hole is drilled are coated with a chemically inert corrosion resistant cathodic electro-deposited film, used commercially to coat many metallic consumer products, and adding in a drain hole at the rear of the muffler to drain out the oil used in the fuel during operation.

Installation is easily done by using the mounting bolt through the hole at the front of the standard front half of the muffler, assembling the standard multichamber muffler, as converted, by passing the bolt through the baffle and holding a nut in position using a conventional socket wrench that can be accessed through the rear exhaust port. A stinger pipe is then slid into the rear of the standard muffler to obtain a proper flow control of the exhaust. The position of the stinger pipe can be adjusted, and then the stinger pipe can be held in place either by friction fit, by "staking" the stinger pipe in position, or using other suitable fastening means such as high temperature current.

When done, the overall muffler gains an additional three sound reducing chambers while increasing the back pressure to the engine a certain amount, but not with enough to reduce power, and often times because of the tuning effect there is an increase in power output. In tests, additional mufflers were added, but no additional sound reduction could be measured because the remaining sound of equal or greater proportion to the engine itself came from the propellers and other structures.

The muffler used in the kit is a standard muffler generally available for four-cycle engines (such as lawn mowers), that has a low back pressure, is small in size, adequately corrosion resistant, and can be easily installed utilizing the kit including the bolt, stinger pipe, and the added mounting hole for the bolt in the main baffle.

DETAILED DESCRIPTION OF THE PREFERRED EMBODIMENTS

Figure 1:
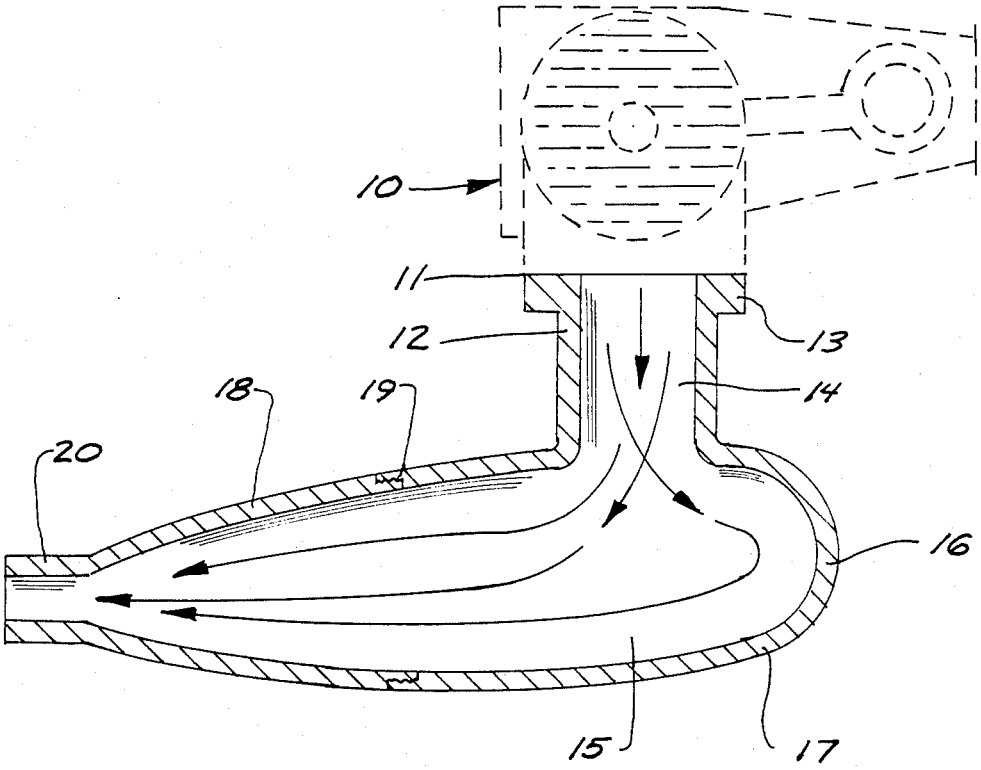
FIG. 1 is a part schematic sectional view of a typical existing model engine and muffler arrangement.

As discussed above, FIG. 1 shows a typical prior art model engine that has a conventional muffler assembly 16 thereon, made into two parts including a forward portion 17 and a rear portion 18 joined along threaded portions 19. In order to accomodate the kit of the present invention which is illustrated generally at 21, the front portion 17 of the muffler 16 is left in position, so that the chamber 15 remains, up to the junction 19. The kit 20 includes a standard four-cycle engine muffler made in high production or high number items, and this muffler 21 for example can be a four-cycle engine muffler for a small lawn mower. Muffler 20 as purchased includes an outer can or housing 22 that is made into two sections, including an inlet section 23 that has a mounting pipe 24 forming a throat passageway 25 that is centered on the longitudinal axis of the muffler. The can 22 includes a rear section 26, that forms an annular chamber, and is joined to the front section 23 at a seam 28 that also clamps a baffle plate 30 in position. The baffle plate 30 extends across the central opening of the housing or can 22, and divides the interior chamber 31 of the inlet section 23 from an interior chamber 32 of rear section 26. This baffle plate 30 has a plurality of openings therethrough as indicated at 33, through which exhaust gas will flow. The openings 33 are selected to be of sufficient number arranged around the baffle (the baffle is disk-shaped, and the can 22 and the sections 23 and 26 are cylindrical) so that a substantial amount of gas will pass through these openings without generating a high back pressure. Additionally, the standard kit muffler 20 includes a cylindrical baffle outlet tube 36 which has a plurality of openings 37 therein around the outer periphery. The gases from the exhaust are to be discharged out a rear opening of the standard kit muffler indicated generally at 38.

In the modifications made, however, the front mounting pipe 24 forming the throat opening 25 is trimmed to a desired length, to reduce the back pressure that is created at the inlet of the standard kit muffler, and the baffle 30 is drilled with a central opening 42. The kit also includes a long mounting bolt 43, which is mounted through a hole 44 that is drilled in the front end of the muffler 16 on the standard model engine.

Figure 2:
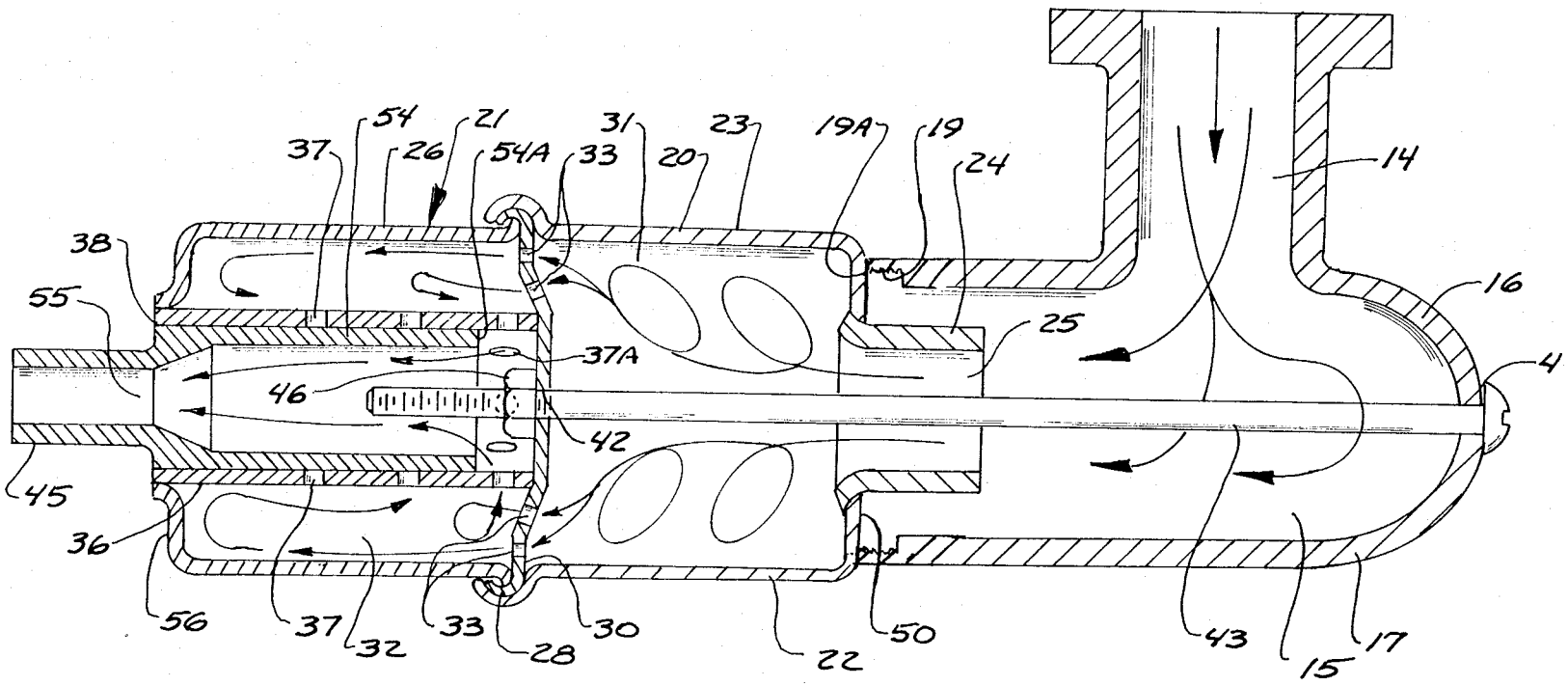
FIG. 2 is a vertical sectional view of the kit of the present invention installed utilizing the method of the present invention on a device such as that shown in FIG. 1.

The kit includes a stinger pipe 45 that is normally assembled in the kit form, so that it is in position shown in FIG. 2 when the kit is received by the owner. The opening 42 is predrilled in the kit muffler, and when the kit muffler is to be assembled, the rear portion 18 of the standard muffler is disassembled by removing it at the junction 19, the hole 44 is drilled in the front of the engine muffler, the bolt 43 is placed through hole 44, and through the inlet pipe 24. The bolt 43 is passed through the openings 44 and 42 (which can be coated with a suitable corrosion resistant material that can be done when the kit is being made), and then a nut 46 is held with a suitable socket as shown in FIG. 2 on the interior of the pipe 37 and the bolt or screw 43 is threaded through the nut. The nut is tightened down to tightly clamp a forward shoulder surface 50 of the front section 23 of the muffler 20 in the kit, to tightly engage shoulder surface 50 against a rear facing surface shown at 19A on the standard or existing muffler.

It should be noted that desired suitable gasketing compound can be used on the surface 19A as long as it is sufficiently heat resistant. It can be seen that the rear stinger pipe has a main barrel portion 54 that slides fairly securely inside the tube 36. The stinger pipe barrel section 54 has an inner end indicated at 54A that is positioned at a desired location spaced from the baffle 30 a desired amount. It is spaced a sufficient amount so that a row of holes or vents in the pipe 36, such as those shown at 37A (there are a number of these holes or openings 37A) are left uncovered. Exhaust gases can pass into the interior of the stinger pipe and the tube 36, but only at controlled locations. The stinger pipe 45 then has an interior chamber indicated at 55 that carries the exhaust gases externally of the muffler. The pipe 45 can be held in place in any desired manner including staking it or screwing in place or with a suitable fastener or cement.

Thus, it can be seen that with a simple kit comprising a standard, commercially available multichamber kit muffler 20, modified to include a central bore opening 42, and a mounting bolt 43 and a stinger pipe for the outlet, noise reduction is easily obtained. The kit muffler can be quickly put into position on the existing model engine muffler 16 to reduce the sound. It also can be seen that in addition to being quickly installed, the kit provides three additional sound reducing chambers, in addition to the chamber 15 that is already existing on the standard muffler. These include the chamber 31 in the inlet section 23, the chamber 32 in the rear section 26 to the outside of the tube 36, and chamber 55 in stinger 45. The rear section 26 of the kit muffler has a desired number of oil drain openings 56 to permit oil from the fuel mix to drain out.

The method of assembly, and the modification to make the kit muffler can easily be made by trimming the standard muffler inlet pipe, boring a hole through the transverse baffle plate 30, installing the kit muffler on the existing muffler 16 utilizing a suitable mounting bolt that clamps a surface of the kit muffler against a surface of the existing muffler to provide a gas seal, and then inserting a stinger pipe in the outlet portion of the kit muffler to control back pressure and direct flow of gases.

Figure 3:
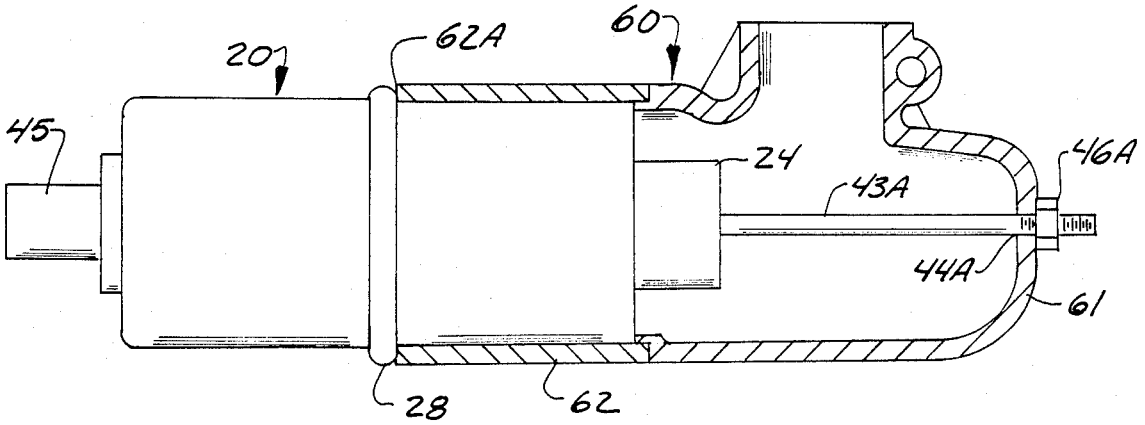
FIGS. 3–10 the muffler kit of the present invention being mounted on different types of manifold-mufflers that are sold for various model engines.

In FIG. 3, a modified form of the muffler of the kit indicated at 20 is illustrated. In this form, a standard engine manifold-muffler 60 has a different engine mounting flange as shown, and has a forward wall 61 in which a hole 44A is drilled. The mounting screw shown here at 43A can be modified so that the threaded outer end can be used with a nut 46A. The kit muffler 20 in this instance is of size to fit within the engine muffler extension pipe 62, so that there is an interfacing surface on the exterior of the inlet section 23 of the kit muffler, and the rim at location 28A will fit against an end surface 62A of the engine muffler for sealing. The bolt 43A passes into the interior of the standard kit muffler 20, modified for the kit as discussed, in a conventional manner. As shown, the nut for tightening the mounting bolt is on the exterior of the manifold.

Figure 4:
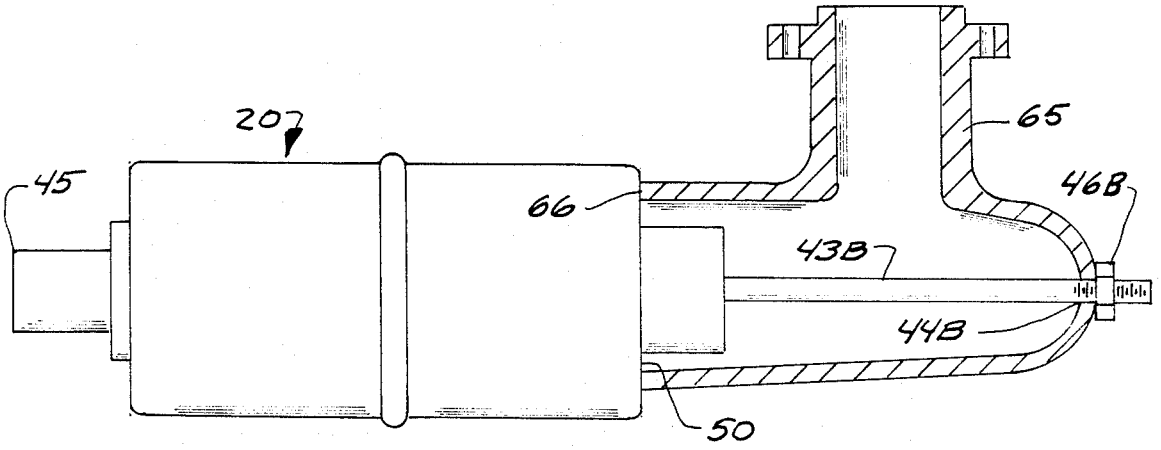

FIG. 4 illustrates a further form of a standard muffler-manifold flange assembly indicated at 65, and a hole 44B is drilled in the front wall of the standard engine muffler 65, to accomodate a screw 43B, using a nut 46B. The kit muffler 20 is of size so that when the rear half of the standard engine muffler 65 is cut off, the shoulder surface 50 will abut against an end surface 66, to provide a sealing action. Again, the screw 43B can have its head on the interior using the baffle 30 as in the form shown in the previous figure. Otherwise, the method and apparatus of the kit is the same as that previously explained.

Figure 5:
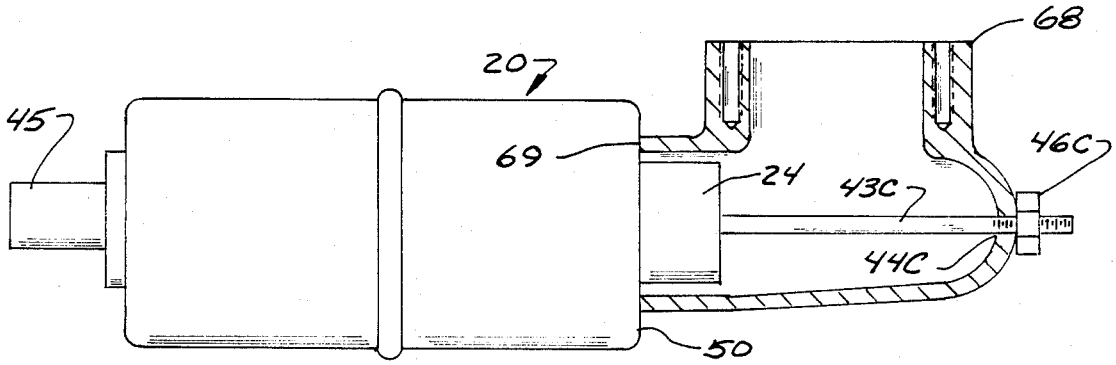

In FIG. 5, a further modified standard engine muffler 68 used with model engines is provided by cutting off or unscrewing the rear half of the muffler, and utilizing a bolt 43C passing through an opening 44C drilled in the front wall of the standard engine muffler 68. A nut 46C is used with the bolt 43C, which has its head positioned in the opening in the baffle 30, and the shoulder surface 50 of the kit muffler abuts against a surface 69 at the rear edge of the engine muffler, where the engine muffler has been cut off. The kit muffler 20 thus can be installed in this type of existing engine muffler 68 quite easily.

Again, the different mounting flanges for the standard engine muffler do not provide any problem in mounting.

Figure 6:
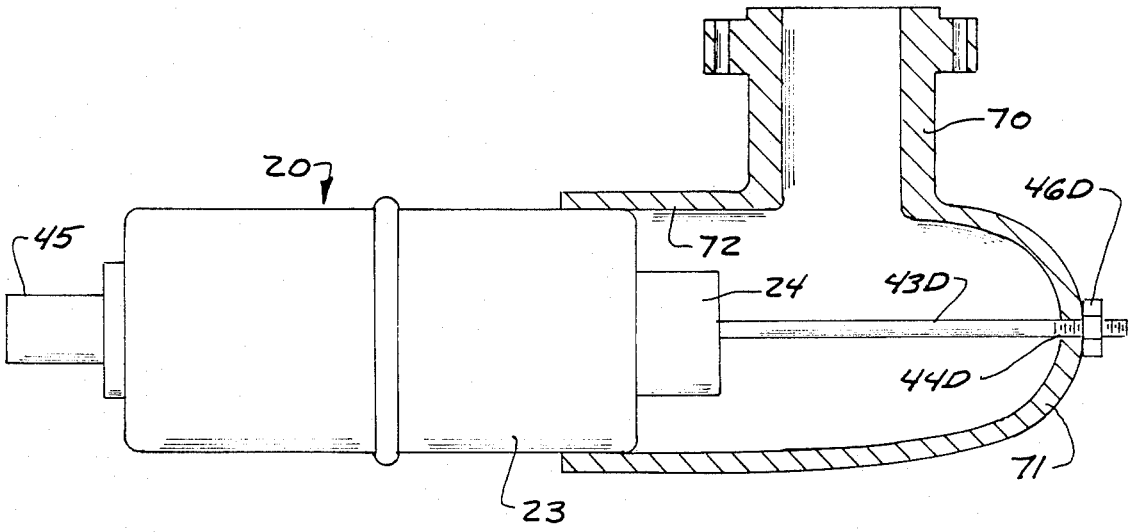

In FIG. 6, a further modified form of the invention is shown attached to yet another standard engine muffler-manifold type arrangement. Standard engine muffler 70 has a different mounting flange arrangement, and the rear half or extension of the engine muffler body is cut off as shown. A bolt 43D is provided in the kit, and an opening 44D is drilled in the forward wall 71 of the engine muffler. A suitable nut 46D is threaded over the hole to hold the kit muffler 20 in place. In this instance, the interface between the interior surface indicated at 72 of the remaining body of existing engine muffler 70 is of size so that the outer surface of the inlet section 23 of the kit muffler 20 can be slid into the rear of the engine muffler and held tightly in position to achieve the operation as previously explained.

Figure 7:
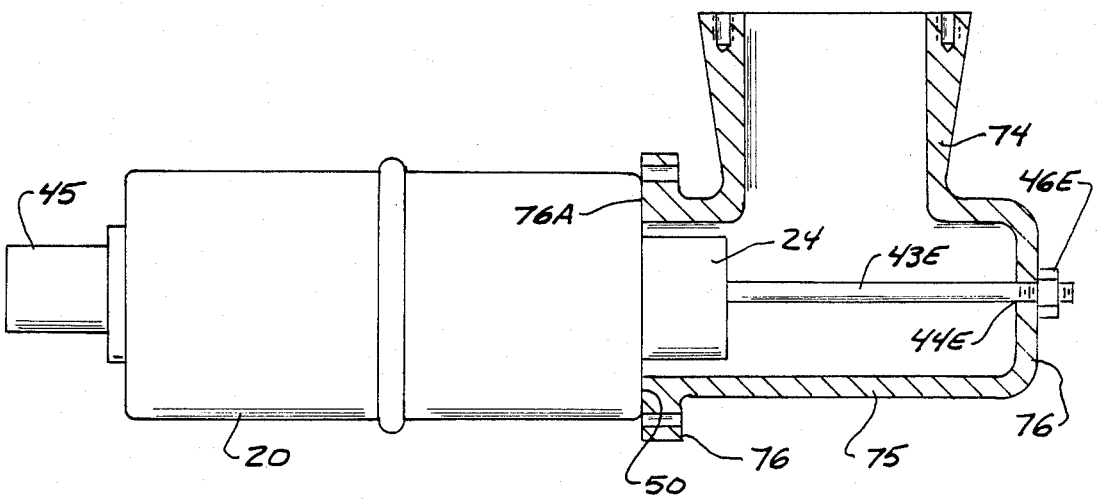

FIG. 7 shows a further muffler-manifold assembly 74 that has a manifold mounting different from the previous forms. The engine muffler body 75 has a front wall 76 in which an opening 44E is made for receiving a bolt 43E. A nut 46E is used as well for tightening the muffler assembly 20 into position. In this form, the standard engine muffler 74 has a rear flange 76 on which normally an extension muffler or tailpipe portion is bolted. In this form, the shoulder surface 50 of the kit muffler is clamped against the flange surface 76A that faces outwardly, for making the seal to the kit muffler, so that gases can enter in through the inlet pipe 24 of the kit muffler and circulate in the chambers formed as previously shown.

Figure 8:
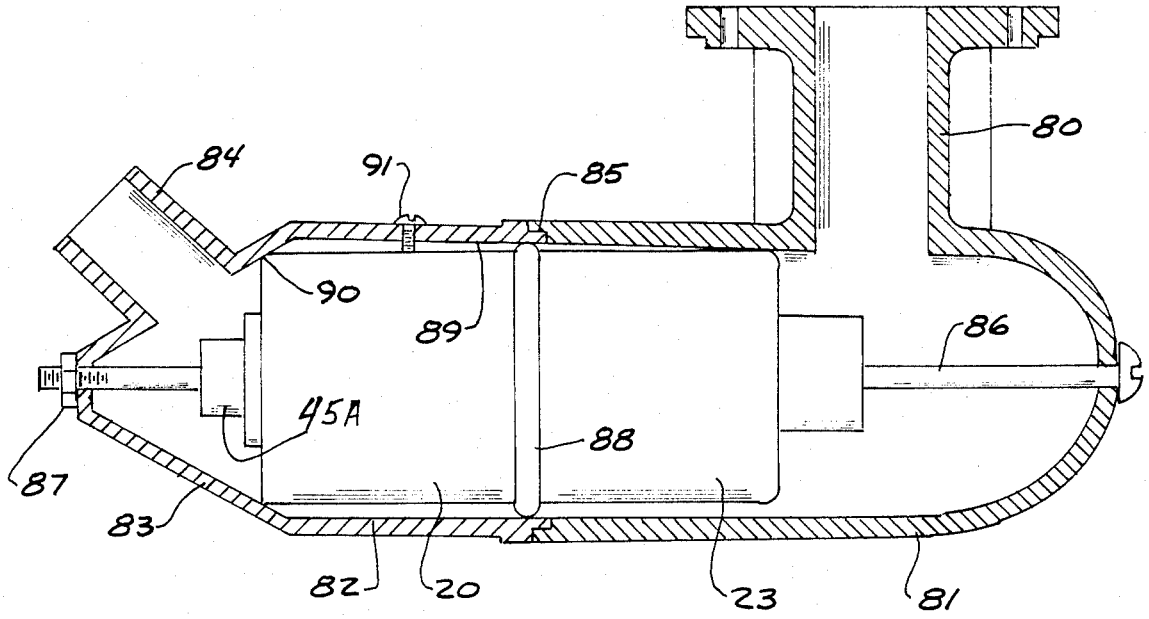

FIG. 8 shows a further modified form wherein a standard engine muffler 80 is made of multiple sections including a main body 81, and a rear body 82 that has a generally cone-shaped discharge chamber. The cone wall 83 has a discharge pipe 84 therein. The rear body 82 is clamped to the front body and mates at a junction shown at 85. An existing muffler assembly bolt indicated at 86 is provided, and the junction 85 is held tight with the bolt 86 and a nut 87 extending through existing openings. In this form, the kit muffler 20 is made as previously explained, except that the bolt 86 passes through the opening in the baffle 30 and extends back into the existing cone portion 83 to hold the kit muffler in assembly. It can be seen that the interface fit surfaces are made by the rim member shown at 88, on the muffler 20 and this provides a seal on the interior surface 89 of the rear engine muffler portion 82.

Additionally, the rear corner 90 of the engine muffler can abut against a tapered surface of cone portion 83. A plurality of self-tapping screws 91 are provided for engaging the kit muffler body and centering and holding it securely in position.

Figure 9:
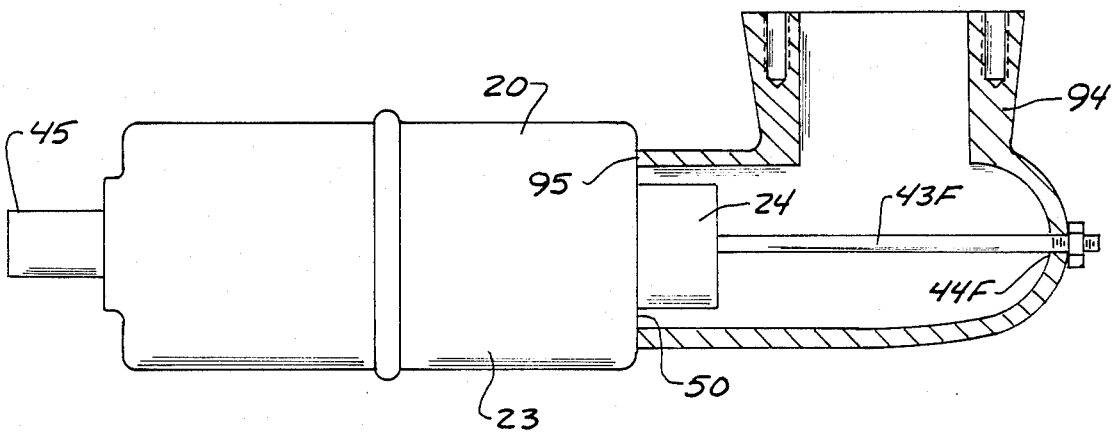

FIG. 9 is a further modified form of the invention, showing an existing engine muffler assembly 94, that is provided with an opening 44F at the forward wall, in which a bolt 43F can be placed. The bolt 43F is passed through the baffle 30 of the muffler assembly 20 in a conventional manner, and the shoulder surface 50 will engage a rear surface 95 of the muffler body 94 for sealing. Exhaust gases again can enter into the inlet pipe 24 of the kit muffler 20.

It should be noted that the stinger pipe 45 of the kit muffler 20 is trimmed off in the version shown in FIG. 8 as desired, in order to provide for clearance so that the exhaust gases can exhaust out through tube 84.

Figure 10:
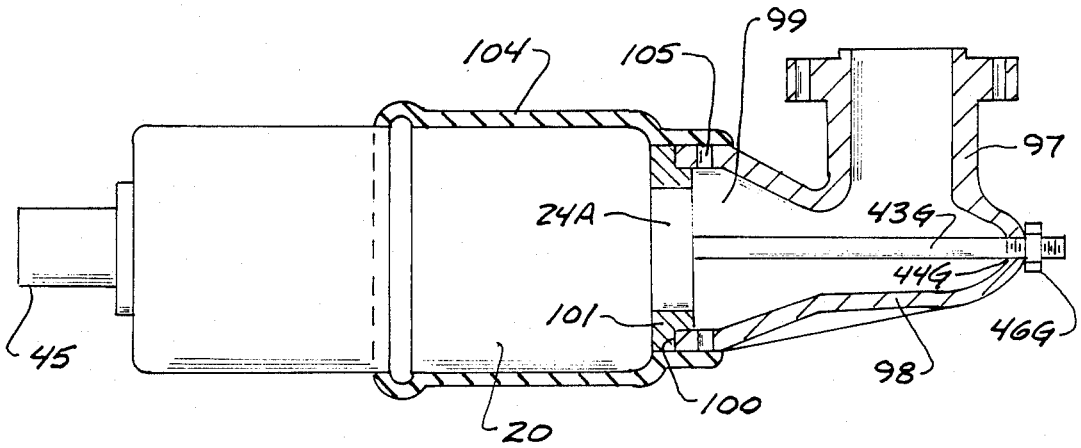

In FIG. 10, a further modified form of the invention is shown, wherein a standard engine muffler 97 has a different configuration for "sport" use. The engine muffler includes a housing 98 with a relatively small diameter rear portion 99 that is cut off. The kit muffler 20 has its front inlet pipe 24 trimmed off so it does not protrude inwardly very far beyond the plane or surface indicated at 100 at the rear of the engine muffler. In this form, a high temperature adapter ring 101 is made to surround the inlet pipe 24 and fit partially within the chamber 99. The ring has a shoulder surface that meets the surface 100, and then a bolt 43G is passed through an opening 44G at the front end of the engine muffler housing. The opening 44G in this instance can be drilled and tapped, so the screw 42 is threaded in to hold the muffler tightly, by turning the head end of the bolt through the stinger passageway. A nut 46G can be threaded on as a lock nut.

The inlet section of the kit muffler and rear portion of the engine muffler can be surrounded with a heat shrink tubing layer indicated generally at 104. The tubing can be shrunk for a tight fit using heated air. This will help seal openings 105 that are used for holding on the existing tailpipe, and because in this form of the invention, the assembly 97, which acts as a manifold, has three openings around its periphery as shown at 105, through which rivets pass to hold on an existing tailpipe. The sealing prevents escape of gases through these openings.

In all forms of the invention, the method is to modify the existing muffler by drilling a hole through a baffle plate, and providing a bolt that clamps the kit muffler in position on the existing engine muffler, and then inserting a stinger pipe to block off an outlet tube in the existing muffler and control the exhaust outlet to a desired level. The method further includes closing a surface of the kit muffler with the existing muffler to establish the gas flow through the kit muffler.

Although the present invention has been described with reference to preferred embodiments, workers skilled in the art will recognize that changes may be made in form and detail without departing from the spirit and scope of the invention.

What is claimed is:

1. A muffler kit for attachment to an existing muffler of a model engine of small size comprising:

a kit muffler of commercial/design having an inlet and an outlet, and having a transverse baffle wall across the muffler between the inlet and outlet;

the baffle wall having a central axial opening therein;

a mounting bolt for passing through said central axial opening and for clamping the kit muffler in position by supporting the kit muffler through the central axial opening in the baffle, surfaces of the kit muffler being positioned to be sealed against an existing muffler to define a flow path through the kit muffler; and a stinger pipe insertable into the outlet opening of said kit muffler or providing a controlled outlet from the kit muffler.

2. The apparatus as specified in claim 1 wherein said bolt is of length to pass through the aperture in said baffle, and to clamp the kit muffler by passing the bolt through an opening in an existing muffler on which the kit is installed, for clamping two surfaces of the kit muffler and existing muffler, respectively, together.

3. The apparatus as specified in claim 1 wherein said kit muffler has an outer shell with a front wall, the inlet forming a pipe extending forwardly from said front wall, and said front wall of said kit muffler being of size to be clamped against a facing surface of the existing muffler through the use of said kit bolt.

4. The apparatus as specified in claim 1 wherein said kit muffler is of size to fit within a bore of an existing muffler, and a flow path being established by causing an exterior surface of the kit muffler to engage an interior surface of an existing muffler when the bolt is tensioned to clamp the kit muffler to an existing muffler.

5. A muffler assembly for a model engine comprising:

a front standard muffler section coupled to the engine, and having a hole defined at a closed end of size to receive a bolt;

a kit muffler having an inlet and an outlet, and having a transverse baffle wall across the muffler between the inlet and outlet, the baffle wall having a central axial opening therein;

a mounting bolt for passing through said hole and the central axial opening and for clamping the second muffler in position adjacent the end of the first muffler by supporting the second muffler, through tension in the bolt reacting against the baffle, to urge surfaces of the second muffler to seal on surfaces of the first muffler to define a flow path through the second muffler; and a stinger pipe insertable into the outlet opening of said second muffler for providing a controlled outlet from the second muffler.

6. A method of converting an existing muffler on a model engine to reduce the sound by use of a second existing standard muffler assembly comprising the steps of:

providing a second muffler assembly that has a central baffle therein extending transverse to a longitudinal axis and having an inlet pipe and an outlet opening at opposite ends thereof, the inlet pipe and outlet opening being centered on the longitudinal axis;

forming an opening in the baffle centered on the longitudinal axis of size to receive a bolt;

passing a bolt through the opening in the baffle, and passing the bolt through an opening in the existing muffler aligning with the longitudinal axis of the second muffler;

tightening the bolt until surfaces of the existing muffler and the second muffler engage; and providing an output pipe inserted into the outlet of the second muffler to control the passage of exhaust gases into the output pipe from the second muffler on an output side of the baffle.

* * * * *

UNITED STATES PATENT AND TRADEMARK OFFICE

CERTIFICATE OF CORRECTION

PATENT NO. : 4,858,722

DATED : August 22, 1989

INVENTOR(S) : David C. Abbe et al.

It is certified that error appears in the above-identified patent and that said Letters Patent is hereby corrected as shown below:

Column 6, line 46, after "muffler", delete "of commercial / design".

Column 6, line 58, delete "or" and insert therefore --for--.

Signed and Sealed this

Eleventh Day of June, 1991

*Attest:*

HARRY F. MANBECK, JR.

*Attesting Officer*

*Commissioner of Patents and Trademarks*